US008172035B2

(12) United States Patent
Fehervari et al.

(10) Patent No.: US 8,172,035 B2
(45) Date of Patent: May 8, 2012

(54) WATERPROOFING LOUDSPEAKER CONES

(75) Inventors: Agota F. Fehervari, Lexington, MA (US); Martin J. Schad, Shrewsbury, MA (US); Shawn Prevoir, Westborough, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 13/073,012

(22) Filed: Mar. 28, 2011

(65) Prior Publication Data

US 2011/0237733 A1 Sep. 29, 2011

Related U.S. Application Data

(63) Continuation-in-part of application No. 12/056,428, filed on Mar. 27, 2008, now Pat. No. 7,913,808.

(51) Int. Cl.
*G10K 13/00* (2006.01)

(52) U.S. Cl. ..... 181/167

(58) Field of Classification Search ..... 181/167
See application file for complete search history.

(56) References Cited

U.S. PATENT DOCUMENTS

| | | | | |
|---|---|---|---|---|
| 3,935,924 | A | 2/1976 | Nagao et al. | |
| 5,458,958 | A | 10/1995 | Kanzaki et al. | |
| 5,480,514 | A | 1/1996 | Suzuki | |
| 5,878,150 | A | 3/1999 | Okazaki et al. | |
| 5,928,588 | A | 7/1999 | Chen et al. | |
| 6,303,669 | B1 | 10/2001 | Fujita et al. | |
| 6,378,521 | B1 | 4/2002 | Van Den Berg | |
| 6,390,232 | B1 | 5/2002 | Kirschbaum | |
| 6,554,962 | B2 * | 4/2003 | Uryu et al. | 162/218 |
| 6,626,262 | B1 * | 9/2003 | Chen | 181/149 |
| 6,752,238 | B2 | 6/2004 | Small et al. | |
| 6,810,129 | B2 | 10/2004 | Nakada | |
| 6,932,187 | B2 | 8/2005 | Banter et al. | |
| 7,006,651 | B2 | 2/2006 | Ueki | |
| 7,913,808 | B2 * | 3/2011 | Fehervari et al. | 181/167 |
| 2006/0013433 | A1 * | 1/2006 | Harrison | 381/432 |
| 2006/0029249 | A1 | 2/2006 | Setiabudi et al. | |
| 2007/0072953 | A1 | 3/2007 | Hachiya et al. | |
| 2007/0137820 | A1 * | 6/2007 | Yasugahira et al. | 162/158 |
| 2007/0158043 | A1 | 7/2007 | Nishida et al. | |
| 2008/0260188 | A1 | 10/2008 | Kim | |
| 2009/0045005 | A1 | 2/2009 | Byon et al. | |

FOREIGN PATENT DOCUMENTS

| | | | |
|---|---|---|---|
| EP | 053345 | A1 | 6/1982 |
| JP | 55-107396 | A | 8/1980 |
| JP | 55-124397 | A | 9/1980 |
| JP | 59-215197 | A | 12/1984 |
| JP | 60030299 | | 2/1985 |
| JP | 03048680 | | 3/1991 |
| JP | 03259699 | A | 11/1991 |
| JP | 04-189099 | A | 7/1992 |
| JP | 04336796 | A * | 11/1992 |
| JP | 04-368098 | A | 12/1992 |

(Continued)

OTHER PUBLICATIONS

International Search Report and Written Opinion dated May 11, 2009, issue for International Application No. PCT/US2009/034278, filed Feb. 17, 2009.

(Continued)

*Primary Examiner* — Forrest M Phillips
(74) *Attorney, Agent, or Firm* — Bose Corporation

(57) ABSTRACT

A water-resistant composite paper, suitable for use as a loudspeaker component, is made from a composition including hydrophobic fibers, stiffening fibers that retain stiffness when wet, and fluorocarbon. In some examples, fibrillated acrylic fibers and glass fibers are used.

12 Claims, 2 Drawing Sheets

FOREIGN PATENT DOCUMENTS

| | | | |
|---|---|---|---|
| JP | 05-083789 | A | 4/1993 |
| JP | 3048680 | | 6/2000 |
| JP | 2000-324591 | A | 11/2000 |
| WO | 2007058170 | | 5/2007 |

OTHER PUBLICATIONS

International Preliminary Report on Patentability dated Oct. 7, 2010, PCT/US2009/034278, 7 pages.

* cited by examiner

WATERPROOFING LOUDSPEAKER CONES

CROSS-REFERENCE TO RELATED APPLICATIONS

This application is a continuation-in-part of and claims priority to application Ser. No. 12/056,428, now U.S. Pat. No. 7,913,808.

BACKGROUND

This disclosure relates to waterproofing loudspeaker cones.

Loudspeakers generally include a diaphragm and a linear motor. When driven by an electrical signal, the linear motor moves the diaphragm to cause vibrations in air. The diaphragm may include a cone, surround, and dust cap. Loudspeaker cones are commonly made of paper. Surrounds and dust caps may also be made of paper. In some applications, loudspeakers are used in environments, such as automobiles, where they are exposed to water. Ordinary paper, made of wood pulp, may not perform well as a diaphragm when exposed to water. The paper may absorb water, which increases its mass and reduces its stiffness, which both affect the sound produced when the motor moves the diaphragm. Other materials, such as aluminum and plastic, when used, may be resistant to water but have other disadvantages as loudspeaker components.

SUMMARY

In general, in one aspect, a loudspeaker component is made from a composition including wood pulp, primary hydrophobic fibers, and stiffening fibers that retain stiffness when wet. The composition is cured into paper forming the component.

Implementations may include one or more of the following features. The primary hydrophobic fibers may include fibrillated acrylic fibers. The stiffening fibers may include glass fibers. The composition may also include a binding agent. The binding agent may include secondary hydrophobic fibers. The binding agent may include polypropylene fibrids. The composition may also include fluorocarbon. The relative proportions of materials in the composition may be uniform throughout the loudspeaker component. The loudspeaker component may be a cone.

The wood pulp may constitute between 30% and 70% by mass of the composition. The wood pulp may constitute 39% by mass of the composition. The primary hydrophobic fibers may constitute between 10% and 30% by mass of the composition. The primary hydrophobic fibers may constitute 20% by mass of the composition. The stiffening fibers may constitute between 5% and 30% by mass of the composition. The stiffening fibers may constitute 20% by mass of the composition. The binding agent may constitute between 10% and 30% by mass of the composition. The binding agent may constitute 20% by mass of the composition. The fluorocarbon may constitute up to 5% by mass of the composition. The fluorocarbon may constitute 1% by mass of the composition. The wood pulp may have a freeness between 350 and 700 CSF.

The fibrillated acrylic fibers may have a freeness between 10 and 600 CSF. The fibrillated acrylic fibers may have a freeness between 40 and 350 CSF. The glass fibers may have an average diameter between 6 and 13 μm. The glass fibers may have an average length between 2 and 8 mm.

In general, in one aspect, a loudspeaker component is formed from a composite paper of uniform material composition and having a wet modulus of at least 40% of the paper's dry modulus and a resistance against surfactant penetration that is significantly higher than that of a cone formed substantially entirely from wood pulp.

In general, in one aspect, a composite paper material includes wood pulp, fibrillated acrylic fibers, glass fibers, polypropylene fibrids, and fluorocarbon.

In general, in one aspect, a loudspeaker includes a linear motor and a cone formed from a composition comprising wood pulp, fibrillated acrylic fibers, glass fibers, polypropylene fibrids, and fluorocarbon.

Advantages include maintaining stiffness and dimensional stability when wet. Wet rub defects in the transducer are reduced. The dry modulus is similar to current cone papers and traditional paper cones. The material has a good resistance against soak-through, low water absorption, and resistance against warping. Good acoustic performance can be achieved, and the cones may be produced on existing cone body manufacturing equipment. The material also has a good heat resistance at high temperatures.

Other features and advantages will be apparent from the description and the claims.

DESCRIPTION

Figure 1:
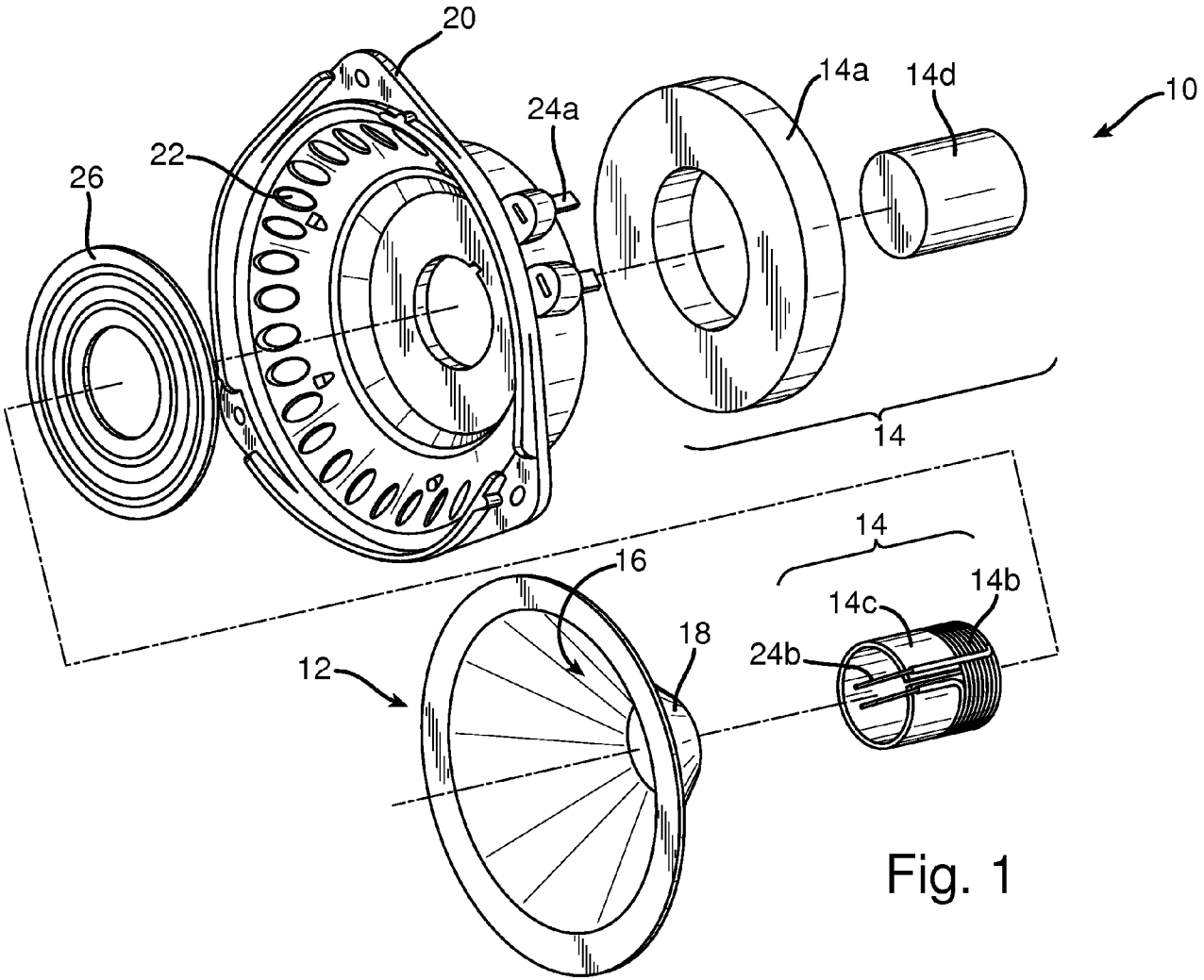
FIG. 1 shows an exploded view of a loudspeaker.

A loudspeaker 10, shown in FIG. 1, includes a cone 12 made of paper, as noted above. In the context of a loudspeaker that will be exposed to water, we refer to the cone as having a wet side 18 and a dry side 16. Other structures, such as the loudspeaker enclosure (not shown), are expected to prevent moisture from reaching the dry side 16 of the cone 12. The relationship of the motor 14 (including a magnet 14*a*, voice coil 14*b*, bobbin 14*c*, and pole 14*d* in the example of FIG. 1) to the wet and dry sides of the cone 12 in FIG. 1 is for illustration only. Other arrangements are possible, for example, the inside of the cone 12 may be the wet side, and the motor 14 may be located inside the volume defined by the cone, independently of which side is wet and which is dry. Other components of the loudspeaker in the example of FIG. 1 include a basket 20 with ventilation holes 22, electrical connections 24*a* and 24*b*, and a suspension 26.

To improve the performance of the loudspeaker 10 when the cone 12 is exposed to water, a mixture of wood pulp and synthetic fibers is used to form the cone paper. Standard wood pulp of a soft wood having typically long fibers can be used with a standard wet-chemistry package, known by those skilled in the art. The synthetic fibers are selected to prevent the absorption of water by the paper and to maintain the paper's material properties if any water is absorbed, such as by stiffening it. Some materials used for the synthetic fibers include acrylics, glass, and polypropylene. The same principles can be applied to other loudspeaker components, such as surrounds, dust caps, or other parts of the diaphragm, and to water-resistant paper products in general.

Hydrophobic fibers, including thermoplastic fibers, reduce the absorption of water and have good flexibility. Examples include fibrillated acrylics, such as polyacrylonitrile (PAN) fibers or copolymers containing at least 85% PAN. The fibrillated acrylics also provide good entanglement with the other fibers in the mixture, providing good formation and retention. Other hydrophobic fibers that may be used include polypropylene, polyester, olefin or polyethylene, polyamide (nylon) and polylactide. A number of other synthetic hydrophobic fibers may be useful, such as commercially available specialty fibers, including PVC (vinyon), polyvinylidene chloride (Saran™ resins from Dow Chemical Company), polytetrafluoroethylene (Teflon® fibers from E.I. du Pont de Nemours and Company (DuPont)), polyurethane-polyethylene glycol (PU-PEG) block copolymer (spandex, e.g., Lycra® fibers from Invista), aramids (aromatic polyamide, including Kevlar® and Nomex® fibers from DuPont), polybenzimidazole (PBI), aromatic polyester (Vectran® fibers from Kuraray Co., Ltd.), thermoset polyurethane (Zylon® fibers from Toyobo Corp.), and polyetheretherketone (PEEK, available from Zyex Ltd.).

Glass fibers help to maintain the material properties, such as the stiffness, of the paper when wet. The surface of the glass fibers may be treated with siloxane to further reduce water absorption by the composite material. Polypropylene fibrids, which are also hydrophobic, provide attachment (or binding) of the other fibers in the mixture to each other. This attachment provides a structural stability to the material. Other binding materials may be used, such as polypropylene emulsions, polyurethane (PU) emulsions, reactive epoxy, and phenolic resin powders. In addition to the synthetic fibers, fluorocarbon provides additional resistance to water penetration or absorption. In some examples, a cationic fluoropolymer, positively charged at a pH below 7 imparts both additional water and grease resistance to the fibers.

Various ratios of the wood and synthetic fibers may be used, depending on the particular material properties needed in a given application and the relative importance of the different properties. For example, increased glass content improves wet modulus. Wood pulp having a CSF (Canadian Standard Freeness) of between 350 and 700 remains the primary component and may make up 30 to 70 percent of the composition by mass. Hydrophobic fibers in a pulp having a CSF between 10 and 600, and more preferably between 40 and 350, may make up between 10 and 30 percent of the composition by mass. Binding fibers may also constitute between 10 and 30 percent by mass. Stiffening fibers having an average diameter between 6 and 13 μm and an average length between 2 and 8 mm, as defined in manufacturers' specifications, may be as little as 5 percent or as much as 30 percent by mass. The fluorocarbon, if used at all, may be as much as 5 percent of the composition by mass.

In one embodiment, the composition includes 39% (by mass) wood fiber having a freeness of 478 CSF, 20% fibrillated acrylic fibers having a freeness of 60 CSF, 20% glass fibers 3 mm long with a diameter of 11 μm, 20% polypropylene fibrids, and 1% fluorocarbon. In some examples, the wood is refined or "beaten" from an initial freeness of ~600 CSF to the lower freeness used. In some examples, refining or beating the wood fiber is not necessary. This composition demonstrates increased tensile modulus in wet tests when compared to traditional paper cones. The wet modulus of the composite cone (the tensile modulus when the paper is wet) is ~0.8 GPa, significantly higher than the ~0.27 GPa of standard cone papers. The composite cone also demonstrates 82% less warping than a traditional paper cone when exposed to water and then dried (95% RH exposure at 65° C. for 65 h, dried at 80° C. for 6 hours). A similar composition having 59% wood fiber, 20% acrylic fibers, 20% bicomponent polyester fibers, and 1% fluorocarbon also has a wet modulus higher than the wet modulus of traditional paper (~0.37 GPa vs. ~0.27 GPa). Both compositions demonstrate significantly longer penetration times for mixtures of water with a surfactant, such as soap (5-50 min. vs. <1 min, tested with a soap-to-water ratio of 1:69.5 in a Mini Britt Jar test), with the composition including glass having a shorter time than the composition without glass. Both compositions also demonstrate lower weight gain due to moisture pickup than traditional paper (~15% vs. ~35%). Another composition uses phenolics as binders in place of the polyester fibers but is otherwise similar to the second composition (i.e., 59% wood, 20% acrylic fibers; 20% phenolic powder; 1% fluorocarbon) and has a similar wet modulus of 0.4 GPa.

Typical paper-making wood fibers, such as such as Q-90 pulp made from black spruce, from Domtar Inc., of Lebel-sur-Quevillon, QC, Canada, or HS400 pulp, made from western red cedar, from Canfor Pulp Limited Partnership, of Vancouver, BC, Canada, or Harmac K10S pulp made from western red cedar, from Pope & Talbot, Inc., of Portland, Oreg., may be used. For the acrylic fibers, examples include CFF 114-3 fibrilated acrylic fibers from EFT/Sterling Fibers of Shelton, CT. Polypropylene fibrids such as product Y600 from the Functional Fabricated Products Division Mitsui Chemicals, Inc. of Toyko, Japan provide the targeted reduction of water uptake and dimensional stability when wet. Glass fibers having the dimensions noted above are available as EC-11-3-SP from JSC Valmiera Glass of Latvia. Suitable fluorocarbon includes AsahiGuard E60 "C6 environmentally friendly fluorocarbon," from AGC Chemicals Americas, Inc., of Bayonne, N.J.

Figure 2A:
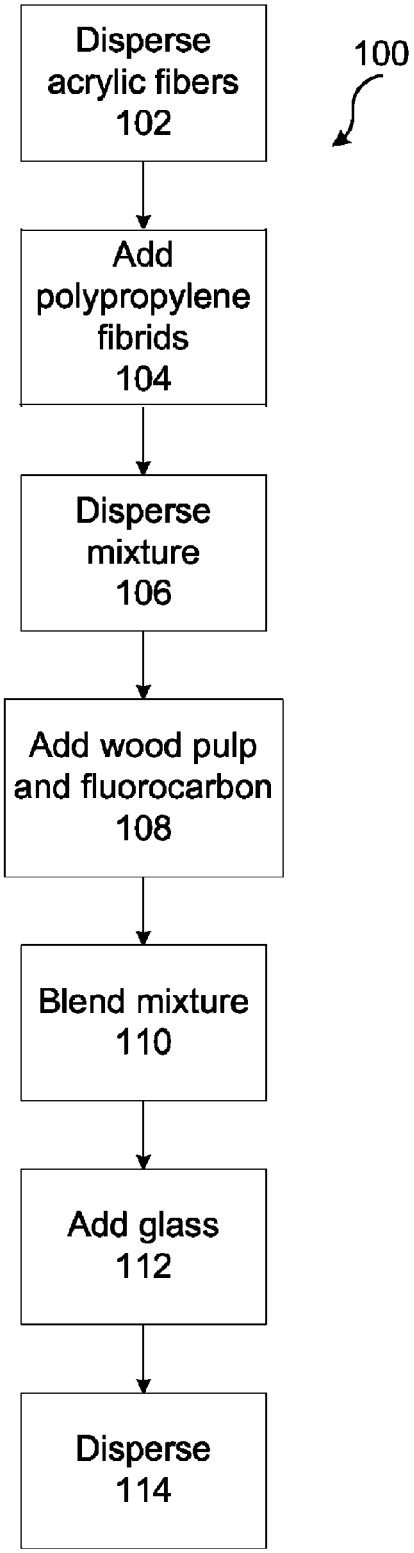
FIGS. 2A and 2B show flow charts.

In some examples, the paper is formed following a process 100 shown in FIG. 2A. The acrylic fibers are dispersed 102 in a water suspension, using a beater or other method of providing high shear, such as a Hydropulper. The polypropylene fibrids are then added 104 to the acrylic fibers and the mixture is again dispersed 106. The refined wood pulp and the fluorocarbon are added 108, and the entire mixture is blended 110. The glass fibers are added 112 and dispersed in the mixture 114 last to avoid damaging them in the earlier blending steps.

Figure 2B:
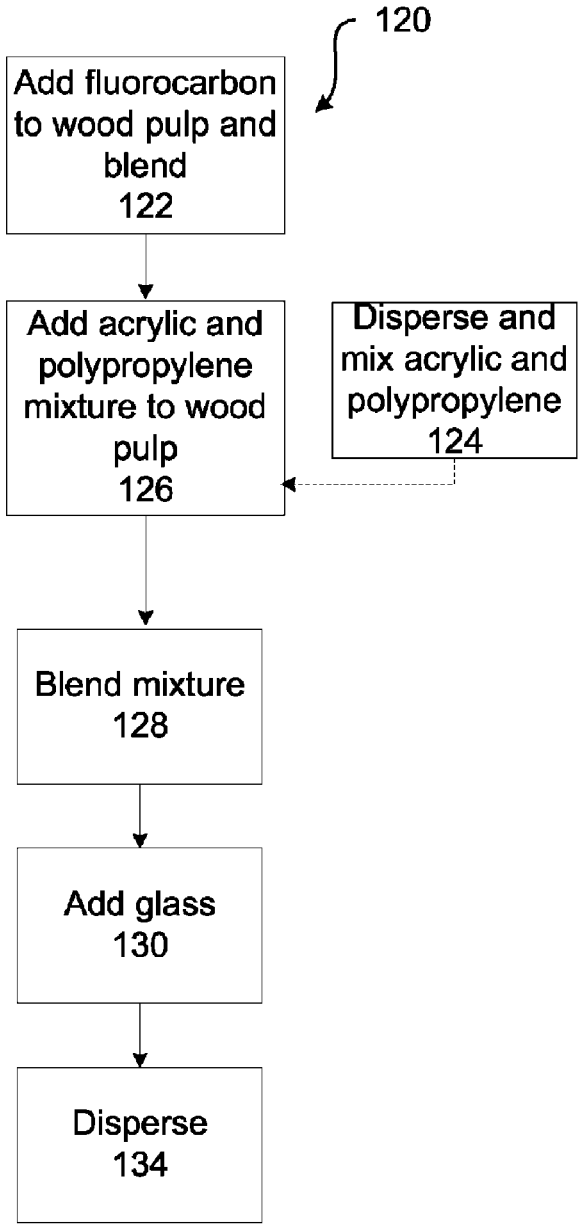

In some examples, the paper is formed following a modified process 120 shown in FIG. 2B. The wood blend is prepared and the fluorocarbon is added 122. The acrylic fibers and polypropylene fibrids are dispersed and premixed 124, possibly well in advance of the pulp mixing process. The acrylic/polypropylene mixture is combined 126 with the wood/fluorocarbon mixture and blended 128 in a mixing vessel. The glass is added 130 and dispersed in to the mixture 134 in a mixing vessel.

After the mixture is completed, cones are formed and cured using paper molding processes, as is generally known in the art. In the examples described, the overall density of paper formed from the composite material was the same as traditional paper, that is, a cone of the same dimensions as a traditional cone has the same mass. Other paper products can also be formed form the same mixture, using other forming processes, as appropriate.

Composite cones made using this composition have been found to have a dry modulus similar to that of typical cone papers. However, the composite cones maintain their stiffness and dimensional stability when wet and through wet-dry cycles much better than traditional papers. Maintaining stiffness and stability when wet reduces wet rub defects (where the voice coil rubs against the pole piece or front plate). The composite material has a good resistance against soap penetration, which improves the durability of other loudspeaker components, low water absorption, which avoids mass loading when wet, and resistance against warping, which decreases variations in performance over time. The composite material also maintains a good resistance to high temperatures.

In another example, the wood pulp described above is omitted, and the composition is made entirely from the synthetic fibers, glass, and fluorocarbon. In tests, loudspeaker cones made from such a composition showed outstanding resistance to clean and soapy water, with full retention of stiffness when wet, and increased damping as compared to 100 percent wood pulp paper or the wood/synthetic composition descried above. In particular, the wet modulus is within experimental error of the dry modulus for various compositions omitting wood pulp, and warping after wetting and drying is negligible.

Examples included fibrillated acrylic fibers which also served as binder fibers, polypropylene hydrophobic fibers and glass stiffening fibers, with a small amount (~1% of total weight) of a fluorocarbon additive to enhance the resistance of the membrane to water and soapy water. All synthetic cones could also be fabricated from a wider variety of synthetic fibers, for instance, bicomponent fibers could serve for bonding (to replace the binder fiber and even partially replace the hydrophobic fiber), and synthetic fibers from high performance engineering plastics could be utilized for enhanced strength and fire retardance (such as Nomex®, Kevlar®, Ultem® from SABIC Innovative Plastics, Inc., polybenzimidazole (PBI), etc.). Other synthetic fibers can be included to tailor the physical properties of the acoustic membrane, such as polyolefins, polyesters, aromatic polyesters (Vectran®), polyamides, polylactides, polyvinyl chloride, polyvinylidene chloride, polytetrafluoroethylene (PTFE or Teflon®), polyurethane-polyethylene glycol (PU-PEG) block copolymers (spandex), thermoset urethane (Zylon®) and polyetheretherketone (PEEK). Improvements over a wood/synthetic mixture include full retention of modulus when wet and potentially improved fire retardance, depending on the selection of fibers.

Manufacture of the fully synthetic cones is similar to the manufacture of the paper composites, but without the use of the wood pulp and related additives. In some examples, Teflon® liners were used in the cone press to eliminate sticking of the synthetics to the press. Compositions having 1 percent fluorocarbon by weight and 5, 10 and 20 percent glass by weight were all found to have suitable performance, with various trade-offs between soap penetration time, wet versus dry modulus, and damping. For all three compositions, retention of stiffness when wet was 80 percent or higher. A particular value within or near the tested range may be selected for the optimal balance of properties in a given application. For the remaining composition, a fifty-fifty blend of acrylic fibers and polypropylene fibrids was used.

Other implementations are within the scope of the following claims and other claims to which the applicant may be entitled.

What is claimed is:

1. An apparatus comprising:

a loudspeaker component made from a composition consisting of synthetic materials, the synthetic materials including:

primary hydrophobic fibers including fibrillated acrylic fibers, stiffening fibers including glass fibers and that retain stiffness when wet, and fluorocarbon;

wherein the stiffening fibers constitutes between 5% and 20% by mass of the composition.

2. The apparatus of claim 1 wherein the stiffening fibers constitute 5% by mass of the composition.

3. The apparatus of claim 1 wherein the stiffening fibers constitute 10% by mass of the composition.

4. The apparatus of claim 1 wherein the stiffening fibers constitute 20% by mass of the composition.

5. The apparatus of claim 1 wherein the relative proportions of materials in the composition are uniform throughout the loudspeaker component.

6. The apparatus of claim 1 wherein the composition further includes a binding agent.

7. The apparatus of claim 4 wherein the binding agent includes secondary hydrophobic fibers including polypropylene fibrids.

8. The apparatus of claim 1 wherein the primary hydrophobic fibers also serve as a binding agent.

9. The apparatus of claim 1 in which the loudspeaker component is a cone.

10. An apparatus comprising:

a loudspeaker component made from a composition consisting of synthetic materials, the synthetic materials including:

primary hydrophobic fibers including fibrillated acrylic fibers, stiffening fibers including glass fibers and that retain stiffness when wet, and fluorocarbon wherein the glass fibers have an average diameter between 6 and 13 μm.

11. The apparatus of claim 10 in which the glass fibers have an average length between 2 and 8 mm.

12. An apparatus comprising:

a loudspeaker cone made from a composition consisting of synthetic materials, the synthetic materials including:

primary hydrophobic fibers including fibrillated acrylic fibers, stiffening fibers including glass fibers and that retain stiffness when wet, and fluorocarbon wherein the composition has a wet modulus of at least 80% of the same composition's dry modulus, and the composition has a surfactant penetration time that is comparable to or longer than the surfactant penetration time of a composition formed at least partially from wood pulp.

* * * * *